United States Patent [19]

Harasym

[11] Patent Number: 4,877,161

[45] Date of Patent: Oct. 31, 1989

[54] TELESCOPING DEVICE FOR UNPLUGGING A VESSEL DISCHARGE PORT

[75] Inventor: Michael F. Harasym, Havertown, Pa.

[73] Assignee: Vesuvius Crucible Company, Pittsburgh, Pa.

[21] Appl. No.: 195,040

[22] Filed: May 17, 1988

Related U.S. Application Data

[63] Continuation-in-part of Ser. No. 930,484, Nov. 14, 1986, Pat. No. 4,746,037.

[51] Int. Cl.[4] ..... C21C 5/48

[52] U.S. Cl. ..... 222/591; 222/603; 266/271

[58] Field of Search ..... 222/603, 593, 523, 591; 266/271; 138/112, 113, 114; 248/49

[56] References Cited

U.S. PATENT DOCUMENTS

| | | | |
|---|---|---|---|
| 3,201,225 | 10/1963 | Haynes | 75/28 |
| 3,743,139 | 7/1973 | Lyman | 222/591 |
| 3,770,200 | 11/1973 | Bauer et al. | 239/102 |
| 3,794,218 | 2/1974 | Yanagida et al. | 222/1 |
| 4,202,533 | 5/1980 | Daussan et al. | 266/271 |
| 4,450,986 | 5/1984 | Harasym et al. | 222/591 |
| 4,746,037 | 5/1988 | Harasym | 266/271 |

FOREIGN PATENT DOCUMENTS 2403522 4/1975 Fed. Rep. of Germany .

*Primary Examiner*—S. Kastler

*Attorney, Agent, or Firm*—Webb, Burden, Ziesenheim & Webb

[57] ABSTRACT

An apparatus for unplugging a vessel discharge port, for example, in a refractory lined ladle or tundish used in the casting of molten steel. The unplugging apparatus is adapted to be placed directly below the plugged discharge port within an axial bore of a refractory pouring tube such as a ladle shroud or like pouring nozzle. The apparatus includes a tubular housing having an axially displaceable tube disposed within the interior of the tube having an upper end disposed above the housing and an open lower end disposed within the housing. A conduit communicates with the interior of the tube at one end and is adapted to communicate with a source of pressurized gas, such as oxygen at the other end. In use, the pressurized gas raises the axially displaceable tube to emit the gas and cause burning in the vicinity of the plugged discharge port. A plurality of radially extending centering members are disposed on the tubular housing for axially aligning the housing relative to the bore of the refractory pouring tube and the discharge port.

17 Claims, 5 Drawing Sheets

TELESCOPING DEVICE FOR UNPLUGGING A VESSEL DISCHARGE PORT

REFERENCE TO RELATED APPLICATION

This application is a continuation-in-part of my copending application Ser. No. 930,484 filed Nov. 14, 1986, now U.S. Pat. No. 4,746,037 and entitled "Improved Apparatus for Unplugging a Vessel Discharge Port".

BACKGROUND OF THE INVENTION

As described in U.S. Pat. No. 4,450,986 to Harasym et al., the discharge port of a vessel for molten metal, which is controlled by a gate valve or the like, often becomes plugged. The unplugging device disclosed in U.S. Pat. No. 4,450,986, the contents of which are incorporated herein, includes a conduit which extends through the wall of an annular member to a lance housing disposed in the annular member, which conduit introduces pressurized gas into the housing. The upper end of the lance housing has a frustrum shaped portion and a reduced diameter cylindrical portion which guides upward movement of the tube. Strict tolerances are required in fabrication of the upper end of the lance housing to ensure that the tube does not become skewed relative to the housing during travel of the tube, so as to prevent binding contact between the tube bottom portion and the interior surface of the housing. The nozzle tip on the tube provides for discharging pressurized gas, while a bottom portion of the tube permits the ingress of a pressurized gas thereto. The reduced diameter portion of the lance housing is elongated so that the relative lengths of the tube and housing are such that the tube does not leave the housing as it travels upwardly to contact plugged material in a vessel discharge port. A pressurized gas for supporting combustion such as oxygen is introduced through the conduit into the lance housing to propel the tube upwardly into contact with the material plugging the discharge port. Heat from the material plugging the discharge port ignites a combustible material positioned within the tube in the presence of the combustion supporting gas. If the pressure of the gas at the tip of the tube is too great, e.g. 250 psi, the discharging gas produces a chilling effect tending to inhibit ignition of the charge of combustible material.

While that device was effective to unplug vessel discharge ports, a further development, as disclosed in my copending application Ser. No. 930,484, the contents of which are incorporated herein, provided for ensuring that the tube is retained in the housing during upward travel and eliminated the chilling effect of the pressurized gas at the upper end of the tube so as to ensure ignition of the charge of combustible material. In that device, a conduit for injection of a gas extends through the wall of an annular member to the lance housing, with the upper and lower ends of the housing disposed, respectively, above and below the conduit elevation. A bushing in the upper end of the housing guides upward movement of a tube which is partially disposed in the housing. The tube carries in its bore a charge of combustible material and the upper end of the tube extends outside the housing while a bottom flared portion of the tube is retained in the housing. The bushing acts to stop the flared portion of the tube from excessive upward movement. A combustible collar mounted on the tube end contains a combustible material, with a portion of the combustible material extending above the elevation of the tube upper end.

SUMMARY OF THE INVENTION

An apparatus for unplugging a vessel discharge port, which vessel has a refractory pouring spout positionable below the discharge port, where the pouring spout has an axial bore. The apparatus has a tubular hollow housing, adapted to be axially positioned in the refractory pouring spout, and an internal chamber in which there is positioned an axially displaceable tube which is at least partially disposed in the housing. The axially displaceable tube has an upper end disposed outside the housing and an open lower end disposed in the housing. A conduit extends from a location exterior of the refractory pouring spout and communicates with the chamber in the housing for introducing a pressurized gas thereto to displace the axially displaceable tube. A plurality of spaced centering members are disposed on the outer wall of the housing to center and stabilize the housing relative to the refractory pouring spout so as to direct a combustible charge atop the axially displaceable tube relative to a plugging material in the nozzle of the vessel. The upper centering members are also load bearing in one preferred embodiment and support the weight of the housing within the refractory pouring spout. A portion of the axially displaceable tube preferably has indentations in the wall thereof to retain the combustible charge therein and to regulate the flow of pressurized gas therethrough.

In a further embodiment, a second axially displaceable tube is at least partially contained within the axially displaceable tube in a double telescoping arrangement so as to increase the length of the apparatus when the same is positioned a greater distance from the plug in the vessel, with indentations in the upper wall of the second axially displaceable tube to retain a combustible charge therein and restrict gas flow. This double telescoping embodiment is particularly suited for use with a collector nozzle wherein the overall height requirements limit the length of the apparatus.

The gas conduit may be arranged to pass through the wall of the refractory pouring spout or the same may enter an open bottom thereof and attach to the bottom of the elongated tubular housing. A further embodiment is adapted for manual insertion into the bottom of a pouring spout.

The apparatus is thus suited for use with refractory pouring spouts or ladle shrouds or collector nozzles of ladle discharge systems or with refractory pouring nozzles of tundish discharge systems.

BRIEF DESCRIPTION OF THE DRAWINGS

The invention will be more fully understood in the drawings, wherein.

DESCRIPTION OF THE INVENTION

The present invention provides an apparatus for unplugging a vessel discharge port such as a discharge port of a ladle or of a tundish.

Figure 1:
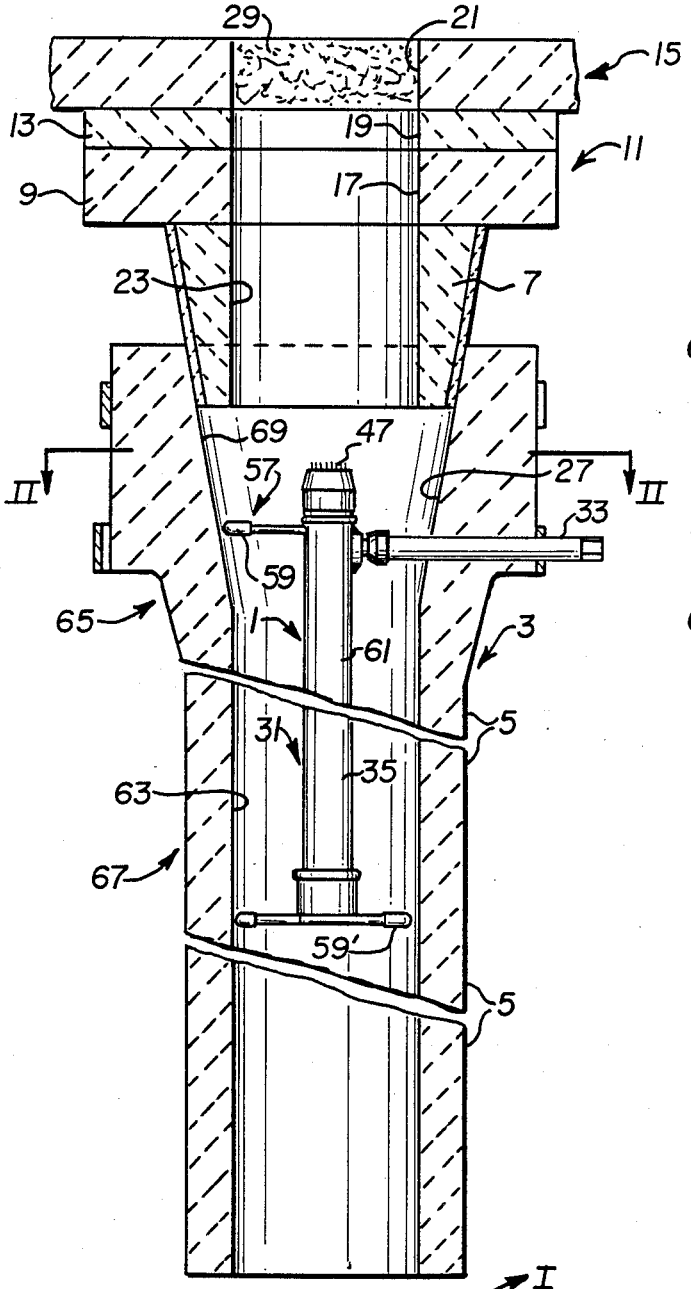
FIG. 1 is a vertical sectional view of a ladle slide plate and ladle shroud incorporating one embodiment of the present unplugging apparatus therein taken along lines I—I of FIG. 2.

Referring now to the drawings, FIG. 1 illustrates an embodiment of the present apparatus 1 in position within a refractory pouring means 3, such as a ladle shroud 5, the shroud 5 being disposed beneath a collector nozzle 7 secured to a movable plate 9 of a gate valve 11. The gate valve 11, is conventional and in addition, comprises a stationary plate 13 attached to the bottom wall of a ladle 15, and the movable plate 9 is juxtaposed to plate 13. Movable plate 9 has a flow passage 17 that is offset from a flow passage 19 in the plate 13, when the gate valve is in closed position. The ladle 15 has a discharge port 21 to which the flow passages 17 and 19 are alignable, and the nozzle 7 has a passageway 23 therethrough, while the shroud 5 has an axial bore 25 formed therein that communicates with the discharge port 21 through the collector nozzle 7 and slide gate valve 11.

The nozzle 7, fixed to the movable plate 15, is preferably a refractory ring having a metal liner on the outer face thereof and the nozzle 7 is tapered on its outer periphery so as to mate with a tapered inner surface 27 and the shroud 5. The ladle shroud 5 is of conventional structure made from refractory material. As described, the axial bore 25 of the shroud 5 is coaxial with passageway 23 of nozzle 7, flow passage 17 of movable plate 9, flow passage 19 of fixed plate 13, and the discharge port 21 in the ladle 15.

Figure 4:
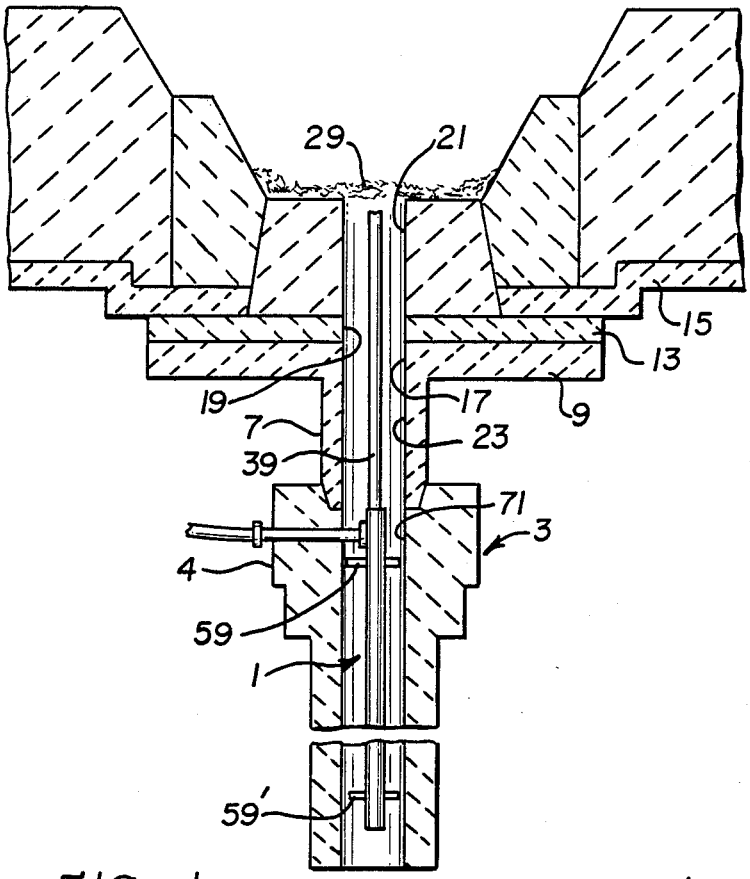
FIG. 4 is a vertical sectional view of a lower section of a ladle and a ladle shroud showing the axially displaceable tube of the present invention in upwardly displaced position.

When the slide gate valve 11 is open, the discharge port 21 is frequently plugged by sand or a solidified skin of molten metal shown as plug 29. The apparatus 1, comprising a telescoping lance 31, according to the present invention, is fitted within the shroud 5 and connected to a conduit 33. The lance 31 includes an outer elongated tubular housing 35 having a hollow interior chamber 37, and an axially displaceable tube 39 (FIG. 4). A gas, such as oxygen, may be introduced under pressure into the interior 37 of the tubular housing 35 by means of the conduit 33. With the bottom of the tubular housing 35, sealed, such as by a threaded plug 41, the pressurized gas will enter the axially displaceable tube 39 through an open lower end such as lower flared opening 43, and, with an apertured bushing 45 fixed to the upper end of the tubular housing and surrounding the axially displaceable tube, the pressurized gas causes the axially displaceable tube 39 to move upwardly so as to physically contact the sand or solidified skin of molten metal at plugged area 29. The flared end 43 has a larger outside diameter than the aperture in the bushing 45 and, thus, prevents the tube 39 from being blown out of the housing 35 accidentally.

Figure 3:
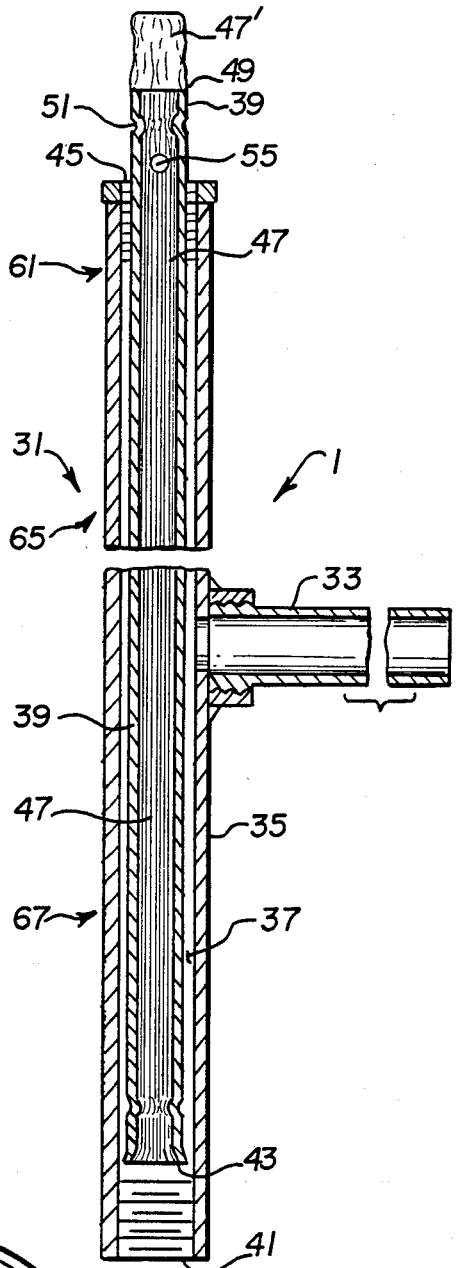
FIG. 3 is a vertical sectional view of an unplugging apparatus according to the present invention.
Figure 2:
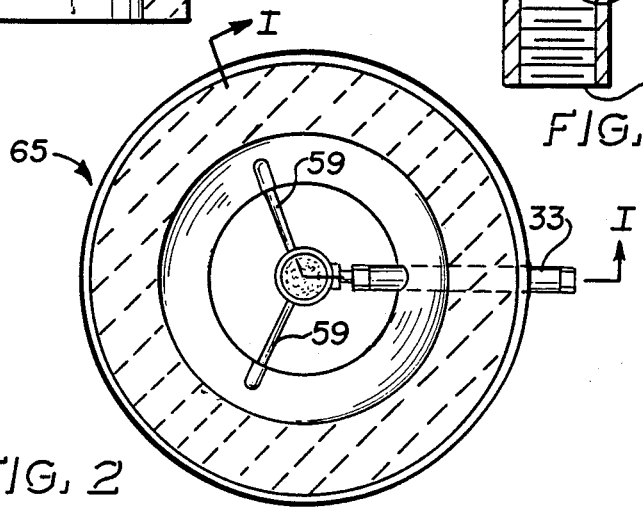
FIG. 2 is a view taken along the lines II—II of FIG. 1.

As perhaps best seen in FIG. 3, an oxidizable or combustible charge of material 47, such as magnesuim wires, carbon steel wires or the like, is provided within the axially displaceable tube 39. The combustible charge preferably extends past the upper end 49 of the axially displaceable tube 39. Indentations 51 are formed in the tube adjacent the upper end 49 of the tube which act as a retaining means for the combustible charge. The indentations 51 may be formed by crimping the wall 53 of the axially displaceable tube 39. The crimped indentations 51 also function to reduce the cross section of the tube 39 so as to restrict the pressurized gas flow and prevent unwanted chilling at the plug burn area. A relief port in the form of a hole 55 may also be provided in the wall 53 of the axially displaceable tube 39 and sized such that some pressurized gas introduced into the axially displaceable tube 39 will bleed through the port 55 to further control the pressure at the upper end of the tube and also prevent unwanted chilling at the burn area. As stated previously, the ends of the combustible charge of wires 47 preferably extend beyond the upper end 49 of the tube 39 as indicated at tip 47′ in FIGS. 3, 5 and 10. Extended tip portion 47′ may include a more highly combustible ignitor means such as steel wool or other detonator means placed among the wires 47 and enclosed by a layer of tape or the like to hold the highly combustible charge in place.

In practice, the tubular housing 35 of steel or iron pipe may be on the order of about 35 inches or more in length, while the axially displaceable tube 39 also preferably of a ferrous pipe material may be on the order of about 36 inches, such that in the resting position, a portion 49 of the axially displaceable tube extends from the interior chamber 37 above bushing 45. Because of the length of the tubular housing 35, it is often difficult to coaxially center the same within a bore of a refractory pouring means such that the flame from the combustible charge is correctly directed towards the plugging matter 29 in the discharge port. In order to achieve a proper alignment of the tubular housing 35 within the refractory pouring spout 3, centering members 57, such as radially extending rods 59 are provided on the outer surface 61 of the tubular housing 35. These radially extending rods extend towards the inner wall 63 of the bore 25. A plurality of said radially extending rods 59, preferably three such rods, are provided at the first location on the upper half section 65 of the tubular housing 35, while a further plurality of rods 59′ are provided at a second location on the lower half section 67 of the tubular housing. The rods 59 and 59′ are preferably spaced at a distance of about 120° from each other about the outer surface 61 of the tubular housing. In those pouring tube or ladle shroud designs where the bore 25 has a tapered enlarged upper portion 27, with a tapered outwardly and upwardly directed inner wall surface 69 provided, the upper rods 59 as illustrated in FIG. 1, may rest on the tapered outwardly and upwardly directed wall surface 69, and provide a load bearing function as well as a centering function. The plurality of rods 59' at the second location on the lower half section 67 of the tubular housing terminate at a spaced location adjacent the inner wall 63 of the ladle shroud 3.

The apparatus depicted in FIG. 3 is particularly suited for manual insertion by an operator into the bottom of a pouring tube (not shown). The operator grasps the pipe 33 which acts as a handle and also serves as the pressurized gas conduit and position the upper section 65 within the bore of the pouring nozzle. The bottom portion 67 of the housing 35 is plugged at 41 to permit the gas to be contained within the interior space 37 of the housing and enter into the tube 39 and cause the desired telescoping action upwardly to the plugged area.

In FIG. 4, the apparatus 1 is illustrated with the axially displaceable tube 39 in extended position in a ladle discharge system wherein the nozzle 7 and movable plate 9 are an integral unit while the refractory pouring spout 3 has a straight inner wall 71. In a system where no tapered inner wall section is present in the pouring spout 3, the centering members 57, in the form of upper 59 and lower 59' radially extending rods all terminate at a spaced location adjacent the inner wall 63 of the refractory pouring spout 3.

Figure 5:
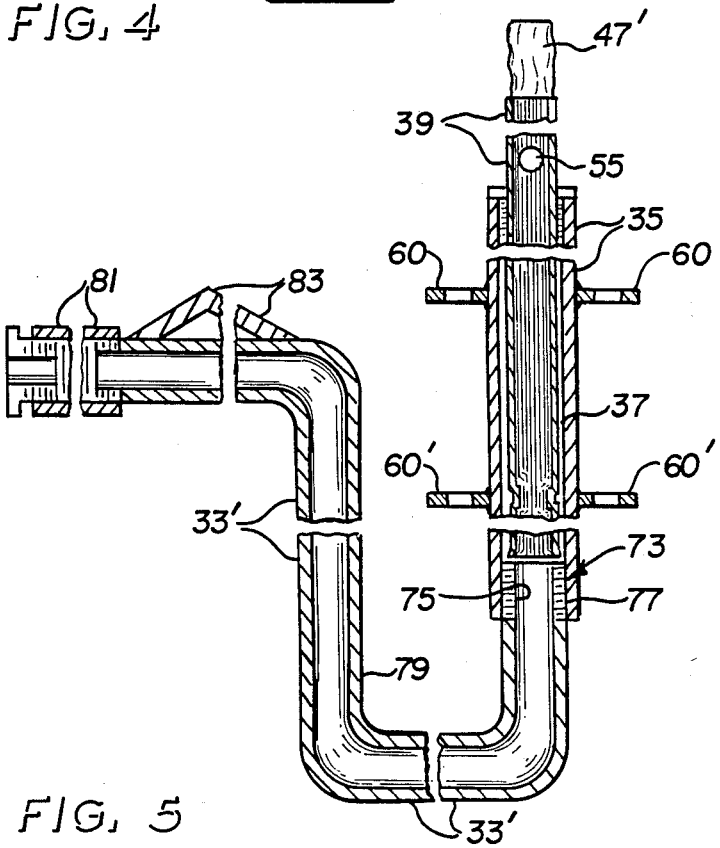
FIG. 5 is a vertical sectional view of an embodiment of unplugging apparatus of the present invention using a gas conduit with an elbow for bottom charging of pressurized gas to the elongated tubular housing of an unplugging apparatus of the present invention.
Figure 6:
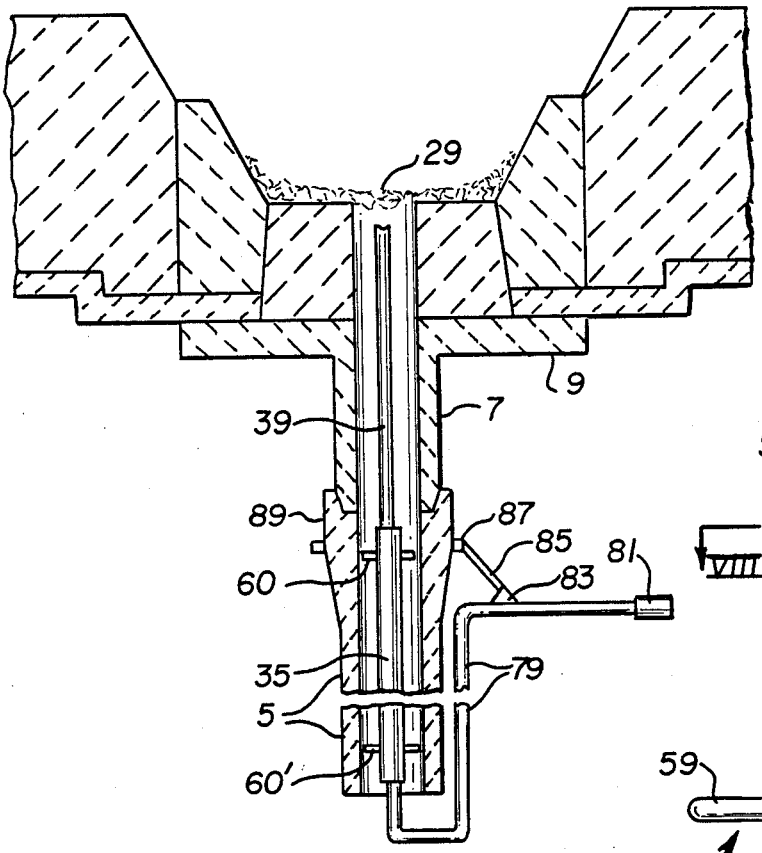
FIG. 6 is a vertical sectional view of a section of a ladle and a ladle shroud showing upward displacement of the axially displaceable tube of the unplugging apparatus illustrated in FIG. 5.

A further embodiment of the apparatus 1 is illustrated in FIGS. 5 and 6 wherein the bottom end 73 of the tubular housing 35 has threads 77 thereon which mate with threads 75 on a gas conduit 33'. This embodiment enables the oxygen gas, under pressure, to be introduced to the chamber 37 of the hollow tubular member 35 without need to pass the gas conduit through the wall of the ladle shroud 5. The gas conduit 33' has an elbow 79, with an attachment means such as threaded nipple 81 for attachment to a source of pressurized gas. In order to aid in supporting the weight of the elbow relative to the shroud 5, a brace 83 may be provided on the elbow that is attached by means of strut 85 to a ring or collar 87 secured to the outer wall 89 of the shroud 5 (FIG. 6). As seen in FIG. 5, the centering members may also take the form of conventional circular washers 60, 60' welded to the outer surface of tubular housing 35 and spaced apart at some uniform distance, such as, for example at 120° intervals.

Figure 8:
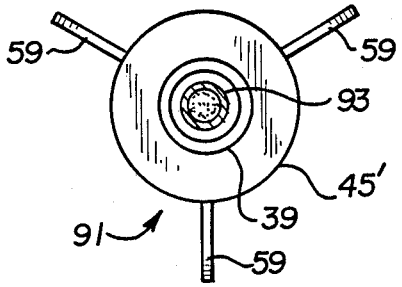
FIG. 8 is a plan view taken along lines VIII—VIII of FIG. 7.
Figure 7:
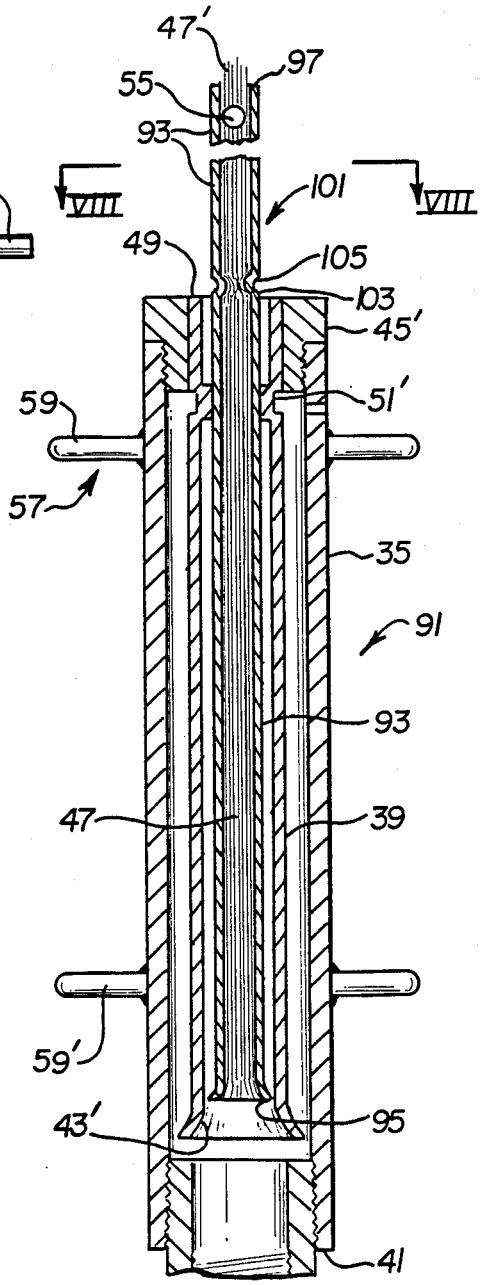
FIG. 7 is a vertical sectional view of a further embodiment of the unplugging apparatus of the present invention using a second axially displaceable tube positioned in the first axially displaceable tube.

A further embodiment of the unplugging apparatus 1 of the invention is illustrated in FIGS. 7 and 8 and designated 91. In this embodiment, a second axially displaceable tube 93 is provided in the axially displaceable tube 39 for reaching longer distances to a sand or metal skin plug formation 29, with the combustible charge 47 contained on the second axially displaceable tube 93.

The second axially displaceable tube 93 is coaxial with the first axially displaceable tube 39 and extends outwardly from the upper end 49 thereof. In addition, the second axially displaceable tube 39 has an open flared lower end 95, while the combustible charge 47 extends outwardly from the upper end 97. The upper end of the charge is indicated at 47'. Indentations 103 are provided in the wall 105 of the upper exposed section 101 that retain the combustible charge securely within the second tube 93. The first axially displaceable tube 39 has an open flared end 43' or other enlarged means which, when extended is retained within housing 39 by an apertured bushing 45'. The first tube 39 also has indentations 51' crimped therein near the upper end which act as a stop to prevent further telescoping of the second tube 93 when the flared end 95 of tube 93 impinges thereon.

Figure 9:
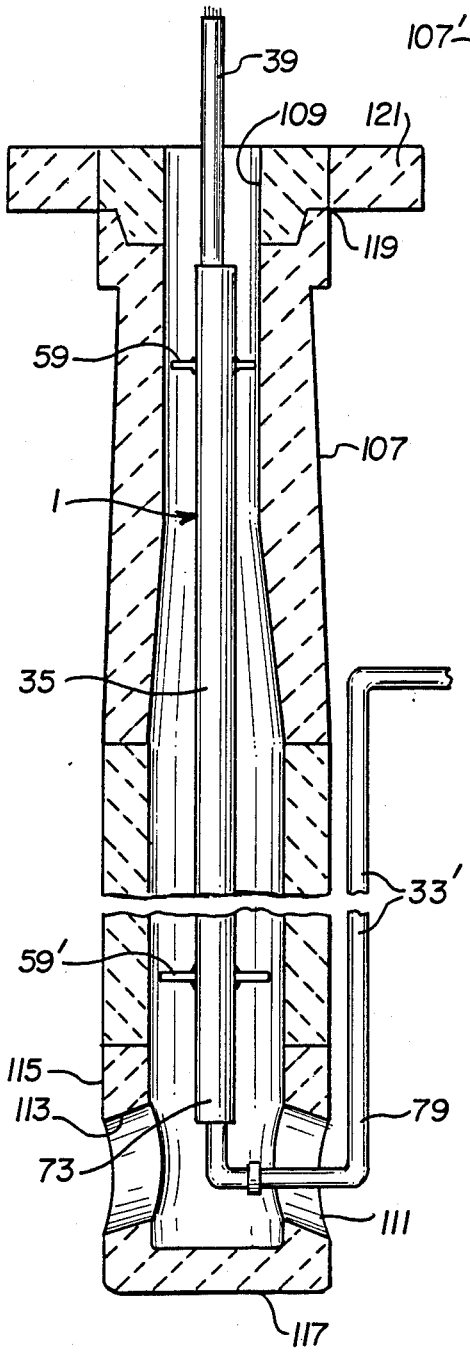
FIG. 9 is a vertical sectional view of a tundish nozzle incorporating an embodiment of the present unplugging apparatus.
Figure 10:
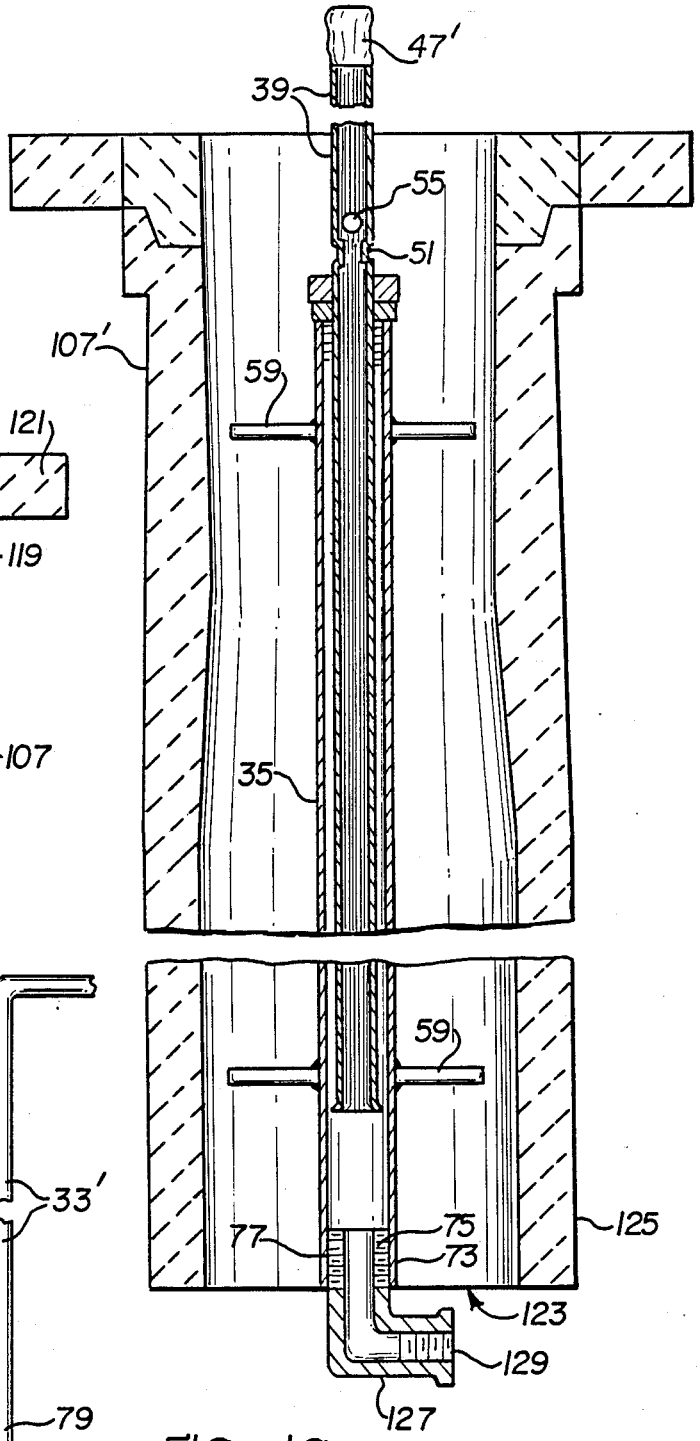
FIG. 10 is a vertical sectional view of another tundish nozzle incorporating an embodiment of the present unplugging apparatus.

In FIGS. 9 and 10, the apparatus 1 is illustrated disposed within a refractory pouring spout such as a subentry style tundish nozzle 107 having an upper open end 109 and a lower end 111. In FIG. 9, the tundish nozzle has side apertures 113 formed in the lower wall section 115, and a closed bottom wall 117. In this embodiment, a pressurized gas conduit 33' is used having an elbow 79 which enables passage of the conduit 33' through the aperture 113 for threaded attachment to the bottom end 73 of the tubular housing 35, as indicated similarly in the embodiment illustrated in FIG. 5. In the embodiment of FIG. 9, the housing 35 is inserted into nozzle 107 through the open top end 109 of the nozzles and the elbow 79 is inserted through the aperture 113 and the gas connection is then made. FIG. 10 illustrates the use of the present unplugging apparatus in a tundish nozzle 107' having a through axial opening 123 at the bottom sections 125 thereof, also with a threaded gas conduit elbow connection (not shown). Threads 77 on the elbow fitting 127 mate with threads 75 on the bottom end 73 of the tubular housing 35, the elbow has a second threaded end 129 to which a gas conduit such as conduit 33' of FIG. 9 is attachable.

Figure 11:
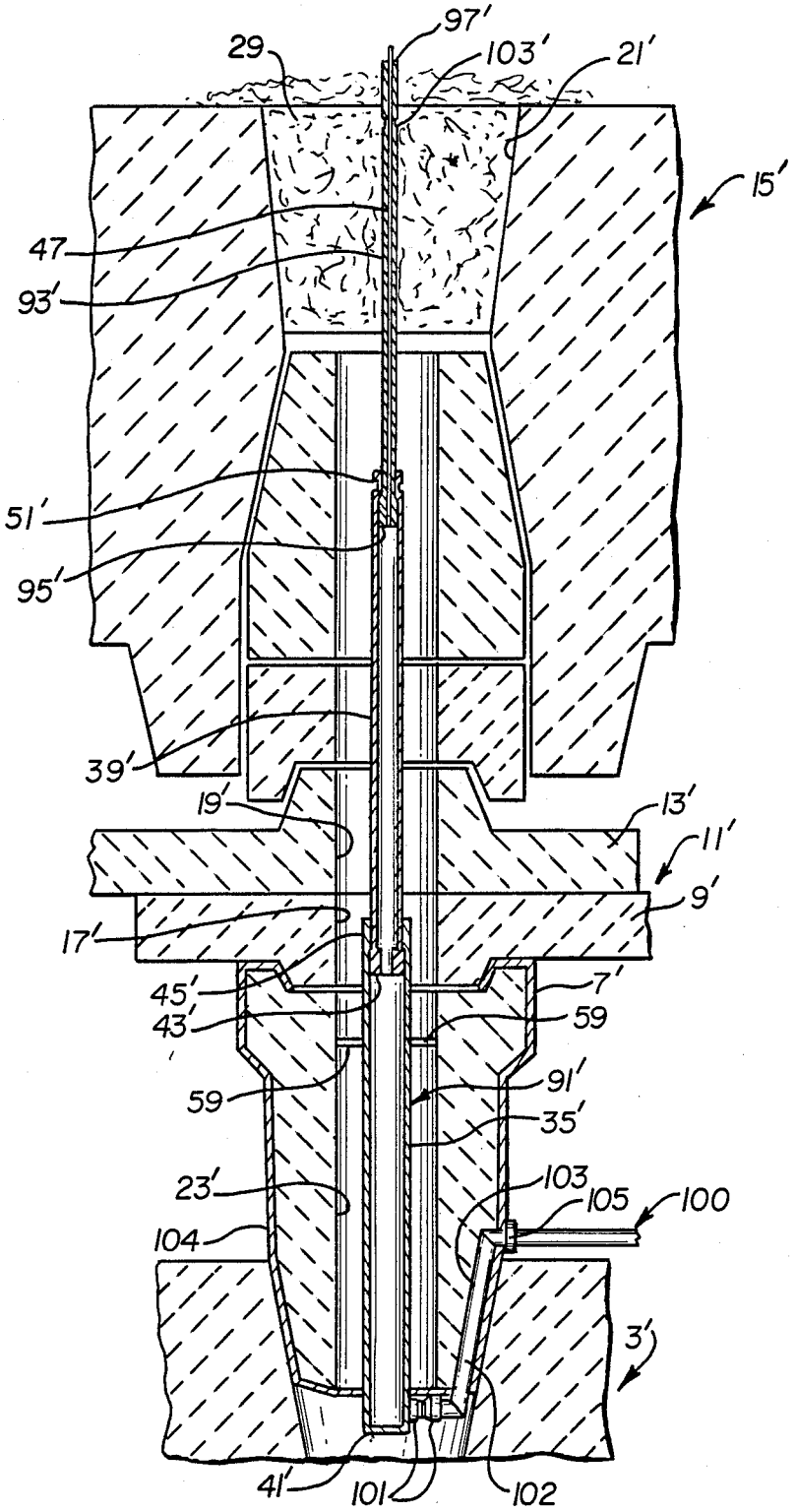
FIG. 11 is a vertical sectional view of a ladle slide plate arrangement showing a double telescoping embodiment of the invention mounted with a collector nozzle.

A further embodiment of a double telescoping apparatus 91' is shown in FIG. 11 as integrally mounted within a collector nozzle 7'. The collector nozzle is shown mounted to the movable plate 9' of a slide gate valve 11'. Plates 9' and 13' slide relative to one another to open and close the metal passageways 17' and 19' which control the molten metal flow from the ladle 15'. Tubular housing 35' of apparatus 91' is fitted within the bore 23' of the collector nozzle 7'. The lower end 41' of housing 35' has a fitting 101 secured thereto which, in turn, is attached to a gas conduit 102. Conduit 102 is situated in a grooved-out portion 103 formed in the side of the refractory collector nozzle 7'. The outer surface of the collector nozzle and conduit 102 is then encased in a steel jacket or can 104 to protect the nozzle and conduit. The collector nozzle 7' is placed into top bore of the ladle shroud 3' such that in use the top of the apparatus 91' in a retracted position can not extend beyond the interface between movable slide gate plates 9' and 13' so as to permit the necessary relative movement between the plates. In such an arrangement, the length of the housing 35' is about 12 inches in length while the distance from the plate 9' to the plugged area 29' of ladle port 21' may be on the order of about 20 inches or more. Hence a double telescoping arrangement comprising axially displaceable first and second tubes 39' and 93' are required to reach such a height when packaged in such a short housing length as limited in housing 35'. The telescoping first and second tubes also carry flared or otherwise expanded ends 43' and 95' to provide stops against bushings 45' and 51'. The flared ends 43' and 95' may take the form of threaded or welded bushings attached to the lower ends of the first and second axially extensible tubes 39' and 93', respectively. The terminal end of gas conduit 103 at the outer surface of the collector nozzle contains a fitting 105 for attachment to a gas conduit 100 which communicates with a source of pressurized gas, such as oxygen. As in the previously described embodiments, the second extensible tube 93' contains a combustible charge 47 which is held in place by crimped indentations 103'. The housing 35' also carries centering members 59 to align the housing within the nozzle bore 23'.

Having thus described my invention with the detail and particularity required by the Patent Laws, what is claimed and desired to be protected by Letters Patent is set forth in the following claims.

What is claimed is:

1. An apparatus for unplugging a vessel discharge port, the vessel having refractory pouring means associated therewith positioned directly below the discharge port, the pouring means having an axial bore formed therein, said apparatus comprising:

an elongated tubular housing having a hollow interior chamber for coaxial placement within the bore of said refractory pouring means;

a condiut communicating with the interior chamber of the housing for introducing a pressurized gas into the housing;

an axially displaceable tube at least partially disposed within said housing, said tube having an upper end disposed outside the housing and an open, flared lower end disposed within said housing, said tube adapted to be projected upwardly when said pressurized gas is introduced into the housing;

bushing means disposed within and secured to an upper end of said housing for axially guiding said axially displaceable tube and for forming a stop for said flared lower end thereof; and a plurality of radially and axially spaced-apart centering members disposed on said elongated tubular housing extending radially outwardly therefrom for axially aligning said housing relative to the bore of said refractory pouring means and to said discharge port whereby said displaceable tube is axially aligned within the bore of the refractory pouring means as it is projected upwardly therein.

2. The apparatus of claim 1 wherein the axial bore of the refractory pouring means includes a tapered inner wall surface and wherein a portion of said centering members extend outwardly adjacent said tapered wall surface and in use are adapted to bear against said tapered wall surface and support a weight of the unplugging apparatus.

3. The apparatus as defined in claim 1 wherein a cumbustible charge of material is disposed within said axially displaceable tube and at least a portion of said tube adjacent the upper end thereof has indentations therein forming a retaining means for said combustible charge and for restricting a flow rate of the pressurized gas through said axially displaceable tube.

4. The apparatus as defined in claim 3 wherein a portion of said combustible charge extends above the elevation of said tube upper end.

5. The apparatus as defined in claim 2 wherein said refractory pouring means comprises a ladle shroud disposable between a discharge port of a ladle and subadjacent tundish.

6. The apparatus as defined in claim 1 whenein said axially displaceable tube is a first tube and has a second tube of a narrower diameter axially displaceable therein, said second tube at least partially disposed within said first tube, said second tube having an upper end disposed outside the housing and the first tube, and having an open lower end disposed within said first tube, and said first tube has an inwardly directed section thereon to center said second tube for axial displacement relative thereto.

7. The apparatus as defined in claim 6 wherein a charge of combustible material is disposed within said second tube and at least a portion of said second tube adjacent the upper end thereof has indentations therein forming a retaining means for said combustible charge.

8. The apparatus as defined in claim 7 wherein a portion of said combustible charge extends above the elevation of the upper end of said second tube.

9. The apparatus as defined in claim 1 wherein said refractory pouring means comprises a nozzle having an open upper end and an open lower end, and said conduit for introducing a pressurized gas to the chamber of said housing comprises an elbow secured to the open lower end of said housing to seal the same and attachment means on said elbow for attachment thereof to a source of pressurized gas through the open lower end of said refractory pouring means.

10. The apparatus of claim 9 including hanger means on said elbow to permit attachment to said nozzle to support a weight of the unplugging apparatus thereon.

11. The apparatus of claim 1 wherein the conduit for supplying pressurized gas to the tubular housing is a rigid pipe and said pipe serves as a handle means whereby the apparatus is adapted to be manually inserted and held in place within the refractory pouring means by an operator.

12. The apparatus as defined in claim 1 wherein said refractory pouring means comprises a tundish nozzle having an open upper end and a lower closed end with a plurality of flow apertures formed therein adjacent said lower closed end, and said conduit for introducing pressurized gas to the chamber of said housing comprises an elbow secured to the open lower end of said housing to seal the same and attachment means on said elbow for attachment thereof to a source of pressurized gas through one of said plurality of apertures in said refractory pouring means.

13. The apparatus of claim 1 wherein a combustible charge of material comprising a plurality of elongated combustible wires are disposed within said axially displaceable tube, said wires having a length substantially equal to a length of said tube and wherein a portion of said tube has indentations therein forming a retention means for said wires and for restricting a flow rate of pressurized gas through said tube.

14. The apparatus of claim 13 wherein the axially displaceable tube has a hole formed adjacent the upper end thereof to provide a vent means for said pressurized gas.

15. The apparatus of claim 13 wherein the combustible wires include one or more combustible materials selected from group consisting of magnesium, carbon steel and like combustible materials.

16. The apparatus of claim 1 wherein the centering members comprise a plurality of rod shaped projections extending around and adjacent to the upper and lower ends of the housing.

17. The apparatus of claim 1 wherein the centering members comprise a plurality of metal washers.

* * * * *

UNITED STATES PATENT AND TRADEMARK OFFICE

CERTIFICATE OF CORRECTION

PATENT NO. : 4,877,161

DATED : October 31, 1989

INVENTOR(S) : Michael F. Harasym

It is certified that error appears in the above-identified patent and that said Letters Patent is hereby corrected as shown below:

Column 5, line 7, after "apparatus" inser --1--.

Column 7, line 43 "cumbustible" should read --combustible--.

Signed and Sealed this

Twenty-fifth Day of September, 1990

*Attest:*

HARRY F. MANBECK, JR.

*Attesting Officer*

*Commissioner of Patents and Trademarks*